US009820338B2

(12) United States Patent
Chadin et al.

(10) Patent No.: US 9,820,338 B2
(45) Date of Patent: Nov. 14, 2017

(54) GLASS PRODUCT WITH ELECTRICALLY HEATED SURFACE AND METHOD OF ITS MANUFACTURE

(71) Applicant: "LASCOM" LTD, Dubna (RU)

(72) Inventors: Valentin Sergeevich Chadin, Obukhovo (RU); Timur Alekperovich Aliev, Noginsk (RU)

(73) Assignee: Lascom, Ltd., Dubna (RU)

( * ) Notice: Subject to any disclaimer, the term of this patent is extended or adjusted under 35 U.S.C. 154(b) by 79 days.

(21) Appl. No.: 14/760,372

(22) PCT Filed: Aug. 5, 2014

(86) PCT No.: PCT/RU2014/000585
§ 371 (c)(1),
(2) Date: Jul. 10, 2015

(87) PCT Pub. No.: WO2015/026266
PCT Pub. Date: Feb. 26, 2015

(65) Prior Publication Data

US 2016/0165668 A1 Jun. 9, 2016

(30) Foreign Application Priority Data

Aug. 23, 2013 (RU) ..... 2013139381

(51) Int. Cl.
*H05B 3/10* (2006.01)
*H05B 3/86* (2006.01)
(Continued)

(52) U.S. Cl.
CPC ..... *H05B 3/86* (2013.01); *H05B 3/0014* (2013.01); *H05B 3/18* (2013.01); *H05B 3/84* (2013.01);
(Continued)

(58) Field of Classification Search
CPC ..... H05B 3/86; H05B 3/0014; H05B 3/18; H05B 3/84; H05B 3/845; H05B 3/0042;
(Continued)

(56) References Cited

U.S. PATENT DOCUMENTS 2,648,752 A * 8/1953 Saunders ..... H05B 3/84 219/543
3,874,330 A * 4/1975 Zoccolini ..... C03C 17/06 118/207

* cited by examiner

*Primary Examiner* — Shawntina Fuqua
(74) *Attorney, Agent, or Firm* — Meyertons, Hood, Kivlin, Kowert & Goetzel, P.C.; Mark R. DeLuca

(57) ABSTRACT

The invention relates to a glass product with electrically heated surface and a method of its manufacture. A method of manufacturing a glass product with electrically heated surface comprises the steps of: producing a substantially transparent substrate; applying a substantially transparent electroconductive layer to the substrate; and forming in the electroconductive layer at least one section with electrically insulated zones separated by electroconductive strips, which at least partially deviate from the longitudinal direction of the section and consist of straight and/or curved portions having substantially the same width w within one section, the width being selected for a specified configuration of electrically insulated zones as a function of desired total resistance $R_{total}$ of the section, consisting of combination of resistances $R_N$ of the strip portions, wherein resistance $R_N$ of each strip portion is determined from the equation: where $R_{\square}$ is the specific resistivity of the electroconductive layer; w is the width of the strip, and $l_N$ is the length of each portion of the strip.

5 Claims, 9 Drawing Sheets

(51) Int. Cl.
*H05B 3/84* (2006.01)
*H05B 3/00* (2006.01)
*H05B 3/18* (2006.01)

(52) U.S. Cl.
CPC .. *H05B 2203/007* (2013.01); *H05B 2203/011* (2013.01); *H05B 2203/013* (2013.01); *H05B 2203/017* (2013.01)

(58) Field of Classification Search
CPC .. H05B 3/023; H05B 3/026; H05B 2203/007; H05B 2203/011; H05B 2203/013; H05B 2203/017; H05B 2203/008; H05B 2203/031; B60S 1/026; B60S 1/023
See application file for complete search history.

GLASS PRODUCT WITH ELECTRICALLY HEATED SURFACE AND METHOD OF ITS MANUFACTURE

TECHNICAL FIELD

The present invention relates, in particular, to a glass product with electrically heated surface and a method of its manufacture, and can be used in various industries, which provide for the use of such glasses.

BACKGROUND ART

Metallization of glass surface is widely used in various fields. An example of such glass is K-glass, which is a high-quality glass having a low-emissivity coating applied to one surface of the glass during its manufacture. Molecules of the metallized coating penetrate deep into the crystal lattice of glass, which makes it very stable, extremely mechanically strong and permanent. Coating obtained using this technology is referred to as "hard" coating.

Glass with low-emissivity coating is also known to be used for the manufacture of glass products with electrically heated surface.

In particular, a glass product with electrically heated surface is disclosed in GB 1051777 A. The technical solution is aimed at heating a glass having a non-rectangular shape, which is accomplished by providing a plurality of individual sections in an electroconductive layer, the sections being connected in groups of successive sections, which groups are connected in parallel in electric circuit.

However this solution has limited application since the division of surface into paired sections allows the attainment of the aim only in a glass product with uniformly changing shape, such as trapezoidal. Furthermore, the need to provide multiple connections between sections complicates the structure as a whole. Also, this solution does not allow heating glass with specified conditions of heating.

The most relevant prior art is described in application EA 201000722 A1, according to which a glass product with electrically heated surface comprises a substantially transparent substrate and a substantially transparent electroconductive layer applied to the substrate, wherein the electroconductive layer comprises one or more sections with a specified surface resistance increased relative to the total surface resistance of the electroconductive layer. In this application, sections with increased surface resistance are formed by figures applied as fragments of lines having predetermined configuration at an angle to each other in a predetermined sequence over the entire surface of glass. The figures are positioned with a predetermined pitch and have the same dimensions within one section of the electrically heated surface.

Basic disadvantages of this prior art include the appearance of heat emission concentration zones at the ends of the line fragments, which is a significant problem, and the fact that due to uncertain shape of the figures formed by angled lines the "pitches" of these figures cannot be accurately aligned in adjacent sections with different surface resistance, this resulting in appearance, between these areas, of zones whose resistance cannot be calculated.

Other disadvantages include the difficulty of calculating dimensions and configurations of the figures to provide the desired surface resistance and, accordingly, the technical complexity of this solution, in particular, the complexity of applying the line fragments.

SUMMARY OF THE INVENTION

The object of the present invention is to overcome the disadvantages of prior art. More specifically, the object is to provide uniform distribution of power of heating elements over the entire surface of a glass product having a predetermined configuration, and to create sections, which provide heating with specified characteristics.

According to the invention there is provided a method of manufacturing a glass product with electrically heated surface, comprising the steps of:

providing a substantially transparent substrate;

applying a substantially transparent electroconductive layer to the substrate; and forming in the electroconductive layer at least one section with electrically insulated zones separated by electroconductive strips, which at least partially deviate from the longitudinal direction of the section and consist of straight and/or curved portions having within one section substantially the same width w, which is selected for a specified configuration of electrically insulated zones as a function of desired total resistance $R_{total}$ of the section, consisting of a combination of resistances $R_N$ of said strip portions, wherein resistance $R_N$ of each strip portion is determined from the equation:

$$R_N = \frac{R_{\square} \cdot l_N}{w}$$

where $R_{\square}$ is the specific resistivity of the electroconductive layer;

w is the width of the strip, and $l_N$ is the length of each portion of the strip.

Preferably, curvature of the curved portions is varied in accordance with a specified function.

According to another aspect of the invention there is provided a glass product with electrically heated surface, comprising:

a substantially transparent substrate; and a substantially transparent electroconductive layer applied to the substrate and containing at least one section with electrically insulated zones having the shape of regular hexagons forming a honeycomb structure and separated by electroconductive strips having substantially the same width within one section, said regular hexagons having the same dimensions within one section and positioned with the same distance between centers of circles circumscribed around them all over the electroconductive layer, wherein specified radius $r_{sp}$ of the circles within one section is calculated by the formula:

$r_{sp}=r_{max}-r_{max}\cdot R_{in}/R_n$, where $r_{max}$ is the maximum radius of the circle for the basic honeycomb structure with adjoining regular hexagons;

$R_n$ is the specified surface resistance of the section, and $R_{in}$ is the surface resistance of the initial section without electrically insulated zones.

Preferably, bus bars are formed along edges of the glass product at a distance from each other.

The electrically insulated zones may comprise an electroconductive layer inside them.

According to the Wiktionary, "strip" as a long narrow area on a surface or in space, distinguished by something from its surroundings.

"Surface resistance" is the electrical resistance of a surface area between two electrodes that are in contact with the material. Surface resistance is also the ratio of voltage of current applied to the electrodes to the portion of current there between, which flows in upper layers of the composite.

"Honeycomb structure" commonly refers to a structure resembling a honeycomb. It is common knowledge that a regular hexagon is the ideal figure to construct a honeycomb structure.

The technical effect provided by the above combination of features includes primarily the absence of heat emission concentration zones, as well as the almost complete absence of a temperature gradient.

Furthermore, formation of electrically insulated zones is much simpler, especially where it is necessary to use variable surface resistance over the heated area. This effect is provided by the alignment of pitch of electrically insulated zones of the used structure in at least two adjacent sections of the electrically heated surface.

Also, the invention ensures rapid formation of different layouts with electrically insulated zones having different resistance magnification factors and a smaller variation step of the resistance magnification factors.

Usefulness of the invention is also in that it provides a method of forming electrically insulated zones, which is more efficient and highly adaptable to streamlined production.

BRIEF DESCRIPTION OF THE DRAWINGS

Other objects and advantages of the invention will become apparent from the following detailed description of preferred embodiments thereof, given with reference to the accompanying drawings, wherein.

DESCRIPTION OF PREFERRED EMBODIMENTS

The following description of preferred embodiments of the present invention is illustrative only and not intended in any way to limit the scope of the invention defined in the appended claims.

Figure 1:
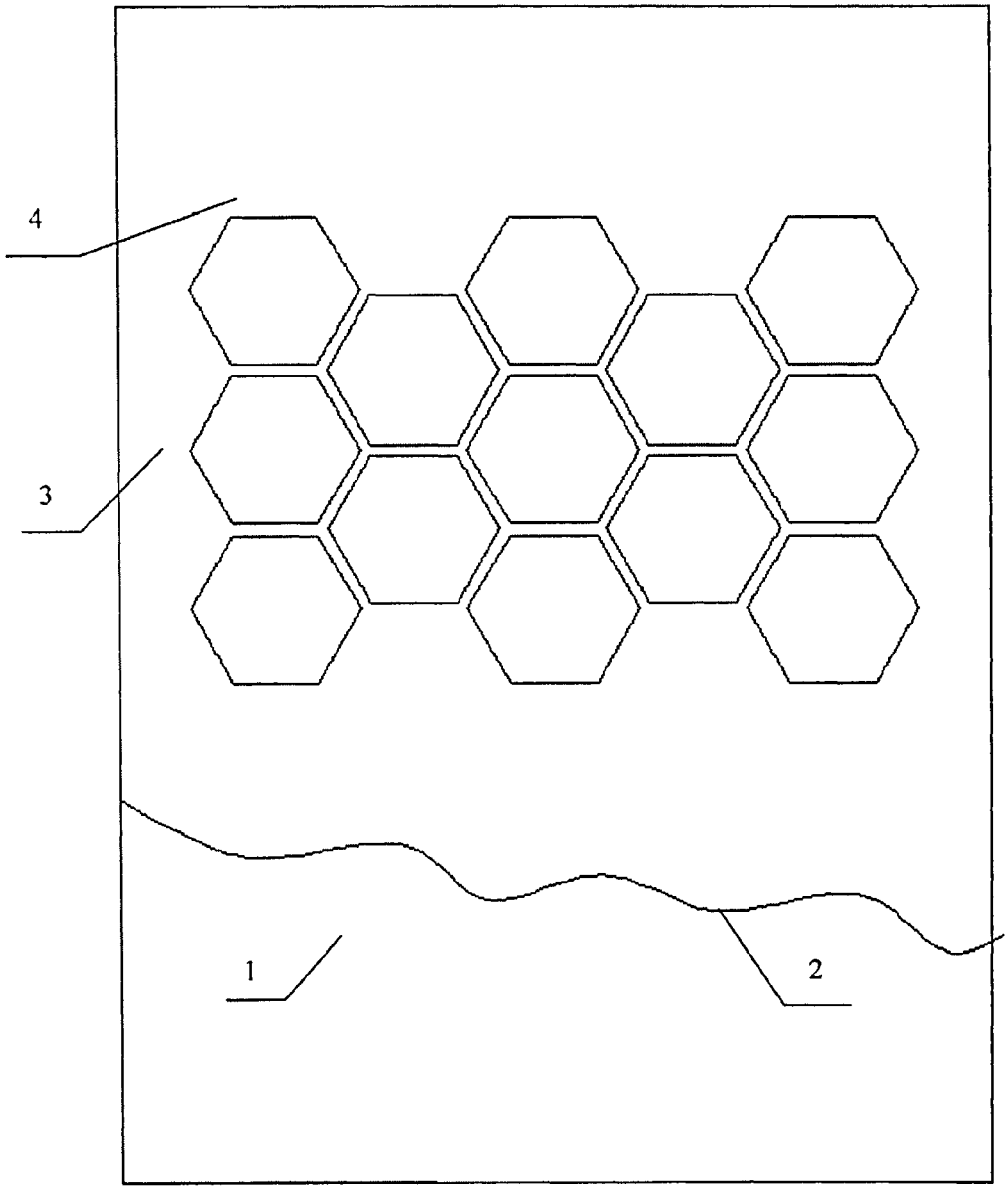
FIG. 1 is a schematic view of a glass product with an electroconductive layer comprising electrically insulated zones.

FIG. 1 schematically shows a glass product 1, which comprises a substantially transparent electroconductive layer 3 applied to a substrate 2, where the electroconductive layer comprises one section consisting of electrically insulated zones 4 in the shape of regular hexagons forming a honeycomb structure. This layout of electrically insulated zones is currently considered to be the most preferred.

Described below is an approximate computation scheme for applying electrically insulated zones on the electroconductive coating of glass (e.g. ship's porthole glass) with predetermined specific heating power and applied voltage.

As an example, 6 mm thick glass with an electroconductive layer (aforementioned K-glass with "hard" coating) may be used, whose coating has specific surface resistivity R□=16-19 ohm□. At the same time, specified specific heating power is $W_{sp}$=7-9 watts/sq dm, and specified applied voltage is $U_{ap}$=220V, 50 Hz. Heating power should be uniform over the entire surface of the electrically heated glass.

Permissible difference in surface temperatures of the electrically heated glass should be within 1-6° C.

Glass with electrically heated surface comprises an electroconductive layer with surface area $S_n$=66 sq dm (size 6×11 dm), specific resistivity $R_{\square}$=17 ohm□, and bus bar width 10 mm.

Dissipated power (W, watts) of initial electroconductive layer can be calculated by the formula:

$$W=W_{sp}\cdot S_n,$$

where W is in the range:

$$W_{mm}=W_{sp\ min}\cdot S_n=7.66=462 \text{ watts};$$

$$W_{max}=W_{sp\ max}\cdot S_n=9.66=594 \text{ watts}.$$

Voltage drop per 1 sq dm of the electroconductive layer of the glass is calculated by the formula:

$$W=V^2/R, \text{ from which } V^2=W\cdot R_{\square};$$

$$V_{max}=\sqrt{7\cdot 17}=10.9\text{V};$$

$$V_{max}=\sqrt{7\cdot 17}=12.37\text{V}.$$

In this case, the length of current path over the surface of electrically heated glass at applied voltage $U_{ap}$=220 V is:

$$L=U_{ap}/V, \text{ where}$$

$$L_{max}=U_{ap}/V_{min}=220/10.9=2018 \text{ mm};$$

$$L_{max}=U_{ap}/V_{max}=220/12.73=1778 \text{ mm}.$$

The predetermined characteristics of electrical heating can be achieved by dividing the surface of the electroconductive layer by straight lines on sides AC and BD into three equal sections (FIG. 2) and by treating the electroconductive layer material with laser radiation to completely remove the coating on these lines to a width from 0.05 mm to several millimeters depending on operating conditions. By successively connecting the three electrically insulated sections we obtain the electroconductive length:

$$(L_{AB}-2\cdot\delta_{bus})\times 3=(600-2\times 10)=1740 \text{ mm, where}$$

$L_{AB}$—length of AB side, δ—width of the bus bar.

The resulting current path length is close to the calculated one; therefore it will observe the conditions for implementation of the predetermined heating characteristics and provide uniform heating. Currently, this is a standard layout employed in electrically heated glasses, the only difference is in the method of removing the coating—the coating material can be treated by laser radiation, etching, and electrochemically. It should be noted that in terms of geometry and width of the resulting electrically insulated lines, completeness of removal of the coating material and improvement of optical characteristics of the glass, the width of each electrically insulated line is preferably not more than 0.035 mm.

The present invention solves the aforementioned object owing to the electrically insulated zones formed in the electroconductive layer in the shape of regular hexagons forming a honeycomb structure, which are arranged with equal distances between centers of circles circumscribed around them and having the same dimensions at least on one portion of the electrically heated surface.

In this case, a structure with electrically insulated zones having specified parameters should be used to allow three-fold increase in the total average specific surface resistivity of the electrically heated layer. The following calculation will explain this.

To provide the total dissipated power at 220 V voltage applied to glass within the 426-594 watts (calculated by the formula above), the total surface resistance of the electroconductive layer should be in the range:

$$R_{in}=V^2/W_m;$$

$$R_{in\ min}=220^2/594=81.5\text{ ohm};$$

$$R_{in\ max}=220^2/462=104.8\text{ ohms};$$

$$R_{in\ av}=(81.5+104.8)/2=93.15\text{ ohms}.$$

Figure 3:
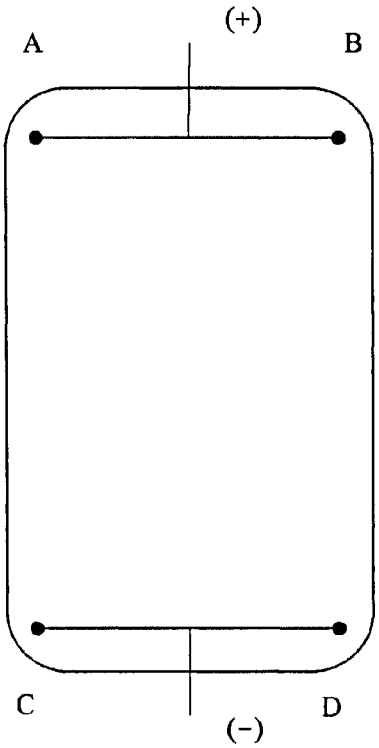

If bus bars are laid along short sides AB and CD (FIG. 3), the initial surface resistance of the electroconductive layer is:

$$R_{in\ surf}=[R_{\square}\cdot(L_{CD}-2\cdot\delta_w)/L_{AB}]=[17\cdot(1120-2\cdot10)/600]=31\text{ ohms}.$$

It is clear that to obtain predetermined heating conditions at specific heating power $W_{sp}$=7-9 watts/sq dm, the total surface resistance should be increased 3 times $R_{in\ av}/R_{in\ surf}$=93.5/31=3. Let's call it magnification factor K=3.

For this factor the honeycomb structure can be calculated based on the above equation:

$$r_{sp}=r_{max}-\frac{r_{max}\cdot R_{in}}{R_{sp}}$$

Therefore, $r_{sp}$ can be calculated based on selected initial dimensions of a basic honeycomb structure with adjoining regular hexagons having a maximum radius of the circumscribed circle, and dimensions of inscribed regular hexagons of the obtained honeycomb structure can be determined.

The resulting honeycomb structure is applied by any conventional method on the electroconductive layer of glass and the desired resistance and desired heating power are obtained, which provide, in turn, uniform heating and permissible temperature gradient.

In this example, dimensions and geometry of glass and specified heating conditions ($W_{sp}$) can solve the task by the traditional method, but there are tasks (for glass with specific geometric shape and size) when the use of the traditional method (zones formed by straight lines) is impossible. Explain this by the following example.

In the example below, the task is to heat the ship's porthole glass shown schematically in FIG. 9. In this case, fitting the glass coating resistance by the traditional method is not possible because when the glass surface is divided into two parts by even a single straight engraved line, the surface resistance increases fourfold; this can be analyzed with the above formulas—it can be seen that the heating power will be unacceptably small to observe the specified heating conditions. The task can be solved using the inventive layouts of electroconductive areas in electrically heated surface.

Figure 2:
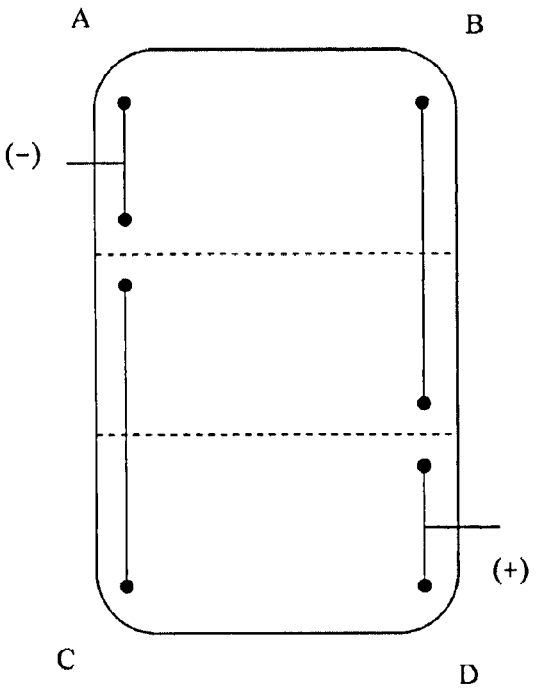
FIG. 2 to FIG. 5 show layouts of bus bars in accordance with computation schemes for resistance of the electroconductive layer.
Figure 4:
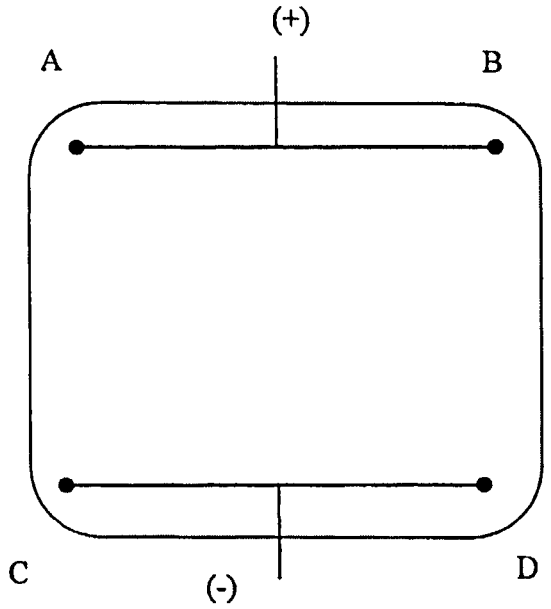
Figure 5:
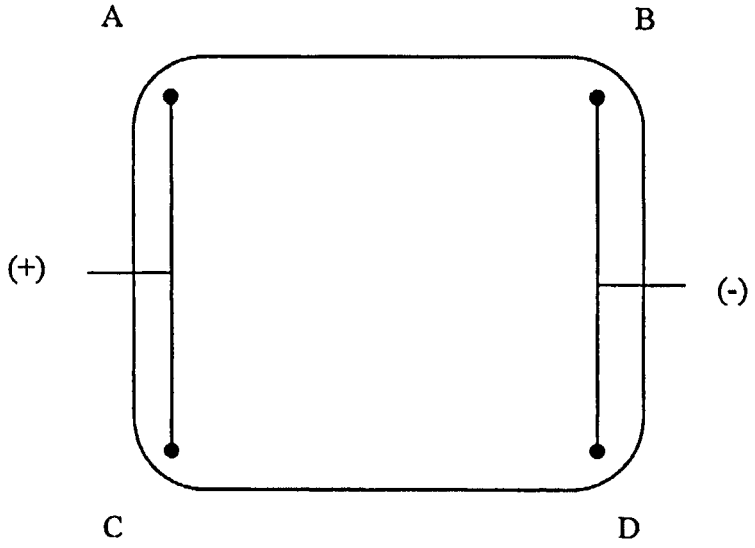

Depending on the design feasibility, bus bars may be positioned along sides AB and CD (FIG. 4), and then the resistance can be increased threefold by adjusting with cut-offs having the required value and applied according to the exemplary layout (FIG. 2). If the bus bars are positioned on sides AC and BD (FIG. 5) on the basis of design considerations, the resistance of the glass surface should be increased by 2.4 times to achieve the specified heating conditions, i.e. the layout of electrically insulated zones calculated for magnification factor K=2.41 should be applied.

Explain this by calculations:

$$W=W_{sp}\times S_n=8\times137=1096\text{ watts};$$

$$R_n=U^2/W=2202/1096=44\text{ ohms};$$

$$R_{in}=[R_{\square}x(L_{AB}-2\times\delta_w]/L_{AC}=18.21\text{ ohms};$$

$$K=R_n/R_{in}=44/18.21=2.41.$$

According to the invention, electrically insulated zones may have own resistance magnification factor K for each section of the electrically heated glass surface.

In particular, to ensure uniform heating of the glass surfaces having complex geometric shape: trapezoid, rhombus, parallelogram, cone, etc. it is necessary to apply layouts with electrically insulated zones, calculated for each particular section of the electrically heated surface, i.e. surface resistance $R_n$ in each section of the electrically heated surface should be determined from the condition $R_n=R_{in}/K$, where $R_{in}$ is the surface resistance of the initial section without electrically insulated zones; K is the resistance magnification factor.

According to the invention one or more sections with a specified resistance increased relative to the initial resistance of the electroconductive layer can be formed in the electroconductive (low-emission) layer before forming electrically insulated zones therein.

More specifically, according to the idea of the present invention, at least one section is formed in the electroconductive layer with electrically insulated zones separated by electroconductive strips, which at least partially deviate from the longitudinal direction of the section and consist of straight and/or curved portions having substantially the same width w within the section, the width being selected for given configuration of electrically insulated zones as a function of the desired total resistance $R_{total}$ of the section, consisting of the combination of resistances $R_N$ of said strip portions, wherein the resistance $R_N$ of each strip portion is determined from the equation:

$$R_N=\frac{R_{\square}\cdot l_N}{w}$$

wherein $R_{\square}$ is the specific resistivity of the electroconductive layer;

w is the width of the strip, and $l_N$ is the length of each portion of the strip.

It is assumed that the configuration of electrically insulated zones can be different provided that the electroconductive strips have a constant width in this particular section. However, it should be understood that the more complex the figure forming the electroconductive zone, the more complicated is the calculation of the required resistance and accordingly the more complicated is the adjustment of zone sizes to provide the desired resistance.

Examples of calculations for illustrative embodiments of electrically insulated zones in accordance with the principles of the present invention are presented below.

Figure 6:
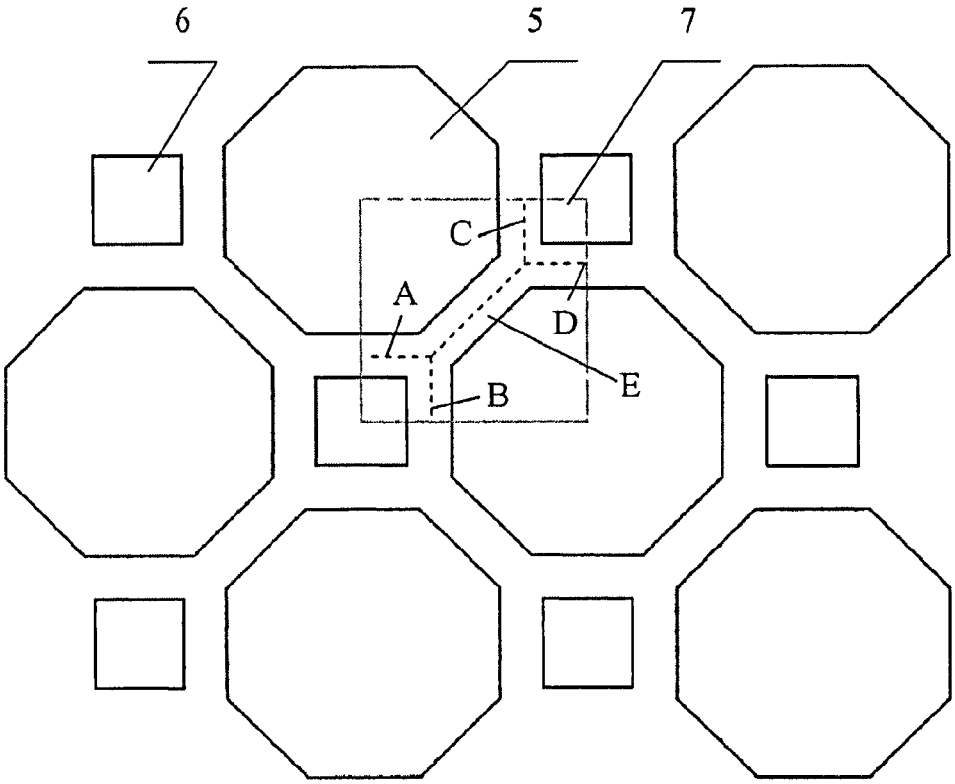
FIG. 6 is a fragment of a structure according to the invention having electrically insulated zones in the shape of octagons and squares.

FIG. 6 shows an exemplary layout of electrically insulated zones, using a combination of two kinds of regular polygons—octagons 5 and tetragons (squares) 6. The main feature of the method is that the size and position of the used figures are preferably chosen so that upon mutually increasing the sizes of the polygons a continuous layer is ultimately obtained, in which the figures adjoin without separating strips. In this case, radii of circles circumscribing the figures will be maximal.

For convenience of calculation a surface of glass with electrically heated (resistive) layer can be divided into fragments in the shape of elementary rectangles 7 (in this case squares) covering the entire area.

It is known that the resistance of a thin film resist can be calculated from the equation:

$$R = \frac{R_{\square} \cdot l}{w}$$

where $R_{\square}$—specific resistivity of the resistive layer (16-19 ohm/$_{\square}$ for K-glass), l—length of the resistor; w—width of the resistor.

Thus, for the elementary square, whose sides are equal, the resistance will be equal to specific resistivity: $R_{el\ sq}=R_{\square}$.

As seen in FIG. 6, each of the squares comprises the following strip portions: A, B, C, D, E.

Determine the total resistance of strips of the square. For the calculation it is assumed that the length of each strip portion corresponds to the length of the strip middle line passing along the adjoining line of the figures, when the figure sizes are increased to maximum such that they adjoin each other.

As is known, length t of sides of a regular octagon is:

$$t = \frac{2r_{min}}{k}$$

where $r_{min}$—maximum possible radius of the circle inscribed in the regular octagon;

k—constant equal to $1+\sqrt{2}$ (≅2,41)

It is also known that the radius $r_{max}$ of the circumscribed circle is:

$$r_{max} = t \cdot \sqrt{\frac{k}{k-1}}$$

Then $$r_{min} = \frac{kt}{2} = \frac{kr_{max}}{2 \cdot \sqrt{\frac{k}{k-1}}}$$

and side t is:

$$t = \frac{r_{max}}{\sqrt{\frac{k}{k-1}}}$$

From FIG. 6 it is clear that length $l_{(A,B,C,D)}$ of each of portions A, B, C, D is equal to t/2, and length $l_E$ of portion E is equal to t. Width w of all portions of the strips is the same.

Surface resistance of each portion of the strip can be determined from the above formula:

$$R_{por} = \frac{R_{\square} \cdot l}{w}$$

Figure 10:
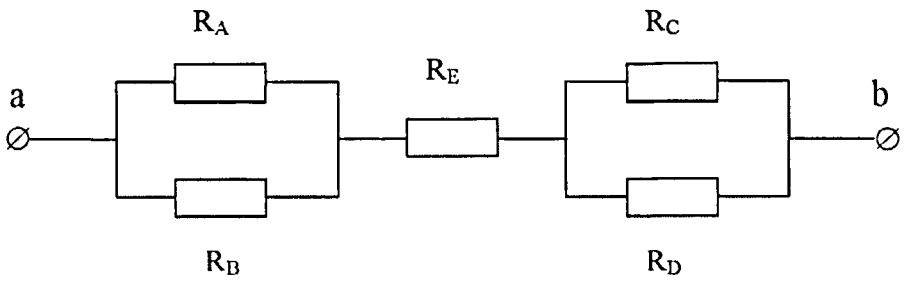
FIG. 10 to FIG. 12 are diagrams showing connection of resistances of strips of different structures according to the invention.

Layout of strips shown in FIG. 6 may be represented as a layout of resistances shown in FIG. 10.

Resistance $R_{sq}$ is:

$$R_{sq} = \frac{R_A \cdot R_B}{R_A + R_B} + R_E + \frac{R_C \cdot R_D}{R_C + R_D}$$

Since $R_A=R_B=R_C=R_D=R_N$, and $R_E=2R_N$, where $R_N$ is the resistance of the strip portion having length t/2 equal to $$R_N = \frac{R_{\square} \cdot l_{(A,B,C,D)}}{w}$$

then $$R_{sq} = \frac{R_N \cdot R_N}{2R_N} + 2R_N + \frac{R_N \cdot R_N}{2R_N} = 3R_N = \frac{3 \cdot R_{\square} \cdot l_{(A,B,C,D)}}{w}$$

Therefore, the width of any strip portion of the section will be $$w = \frac{3R_{\square} \cdot l_{(A,B,C,D)}}{R_{KB}} = \frac{3R_{\square} \cdot t}{2R_{KB}}.$$

Since $R_{sq}$ is the resistance in the elementary square, which as shown above is a surface portion, in which the resistance is the same as that in every other such square within this section of the electroconductive layer, it can be assumed that $R_{sq}=R_{sec}$ (resistance of section).

$$\text{Consequently} = \frac{3 \cdot 17 \cdot t}{2R_{sec}}.$$

For example, if a layout is selected, in which radius $r_{max}$ of the circumscribed circle of the octagon is 14 mm, then $$t = \frac{r_{max}}{\sqrt{\frac{k}{k-1}}} = \frac{14}{\sqrt{\frac{2.41}{2.41-1}}} = 10.7 \text{ mm}.$$

For the above case, where the total surface resistance of the electroconductive layer consisting of one section, $R_{total}$= 93.15, width w will be:

$$w = \frac{3 \cdot 17 \cdot t}{2 \cdot 93.15} = \frac{3 \cdot 17 \cdot 10.7}{2 \cdot 93.15} = 2.93 \text{ mm}$$

Figure 7:
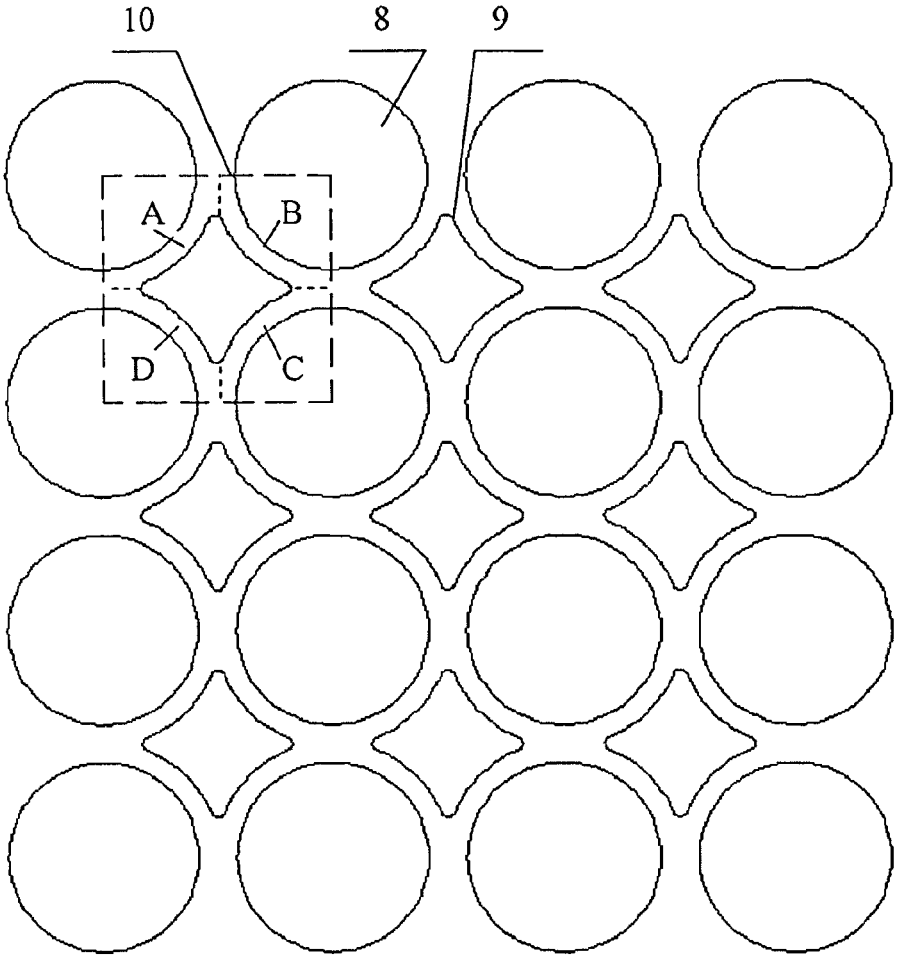
FIG. 7 is a fragment of a structure according to the invention having electrically insulated zones in the shape of circles and four-beam stars.

Another exemplary embodiment shown in FIG. 7 has a layout, which uses a combination of two other kinds of figures: circles 8 and four-beam stars 9. In this case, shapes and dimensions of the figures are selected so that upon mutually increasing their sizes a solid layer is eventually obtained, in which the figures adjoin without separating strips. However, to avoid the formation of heat release concentration zones, ends of the star-shaped figures are preferably rounded.

For convenience of calculation the glass surface in this case can be also divided into fragments having the shape of elementary squares 10 covering the entire area.

As seen in FIG. 7, each of the squares has four strip portions in the shape of arcs A, B, C, D.

Determine the total resistance of strips of the square. For calculation it is assumed that the length of each strip portion corresponds to the length of the strip middle line passing along the adjoining line of the figures, when the dimensions of the figures are increased to maximum such that they adjoin each other, i.e. length $L_{(A,B,C,D)}$ of each strip portion is approximately equal to the length of 45° arc at the maximum radius of the circle:

$$l_{(A,B,c,D)}=2\pi r_{max}/4=\pi r_{max}/2.$$

Surface resistance of each strip portion can be also determined from the above formula:

$$R_{por} = \frac{R_{\square} \cdot l}{w}$$

Figure 8:
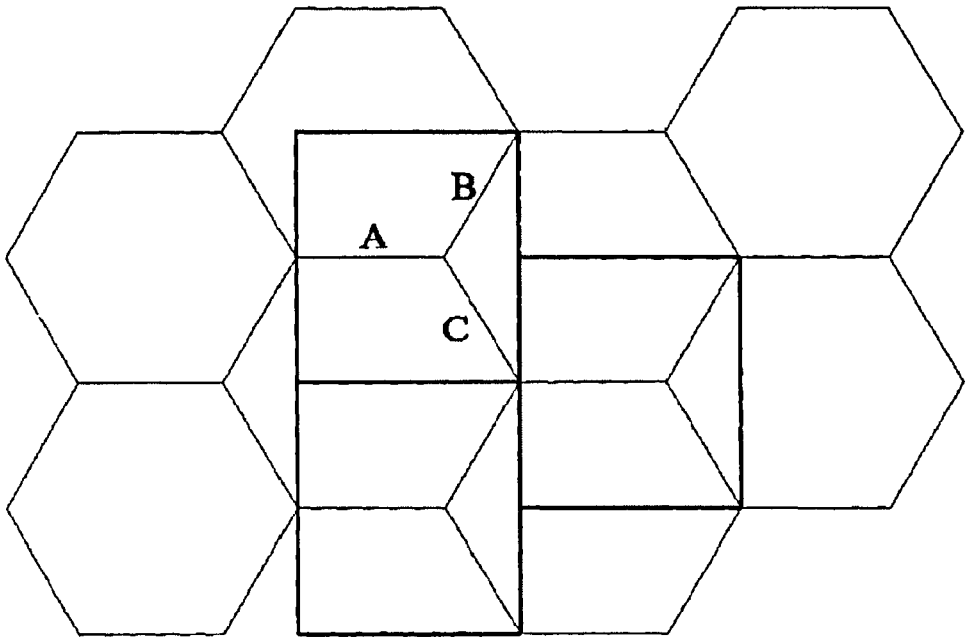
FIG. 8 is a fragment of a basic honeycomb structure with adjoining regular hexagons, which shows elementary rectangles.
Figure 11:
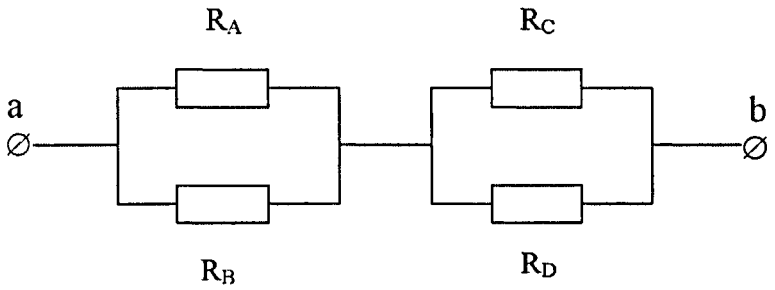

Layout of strips shown in FIG. 8 may be represented as a resistance circuit shown in FIG. 11.

Resistance $R_{sq}$ is equal to:

$$R_{sq} = \frac{R_A \cdot R_B}{R_A + R_B} + \frac{R_C \cdot R_D}{R_C + R_D}$$

Since $R_A=R_B=R_C=R_D=R_N$, and $R_E=2R_N$, where $R_N$ is the resistance of section, equal to $$R_N = \frac{R_{\square} \cdot l(A, B, C, D)}{w},$$

then $$R_{sq} = \frac{R_N \cdot R_N}{2R_N} + \frac{R_N \cdot R_N}{2R_N} = R_N = \frac{R_{\square} \cdot l(A, B, C, D)}{w}$$

Therefore, width of any strip portion of the section will be equal to:

$$w = \frac{R_{\square} \cdot l(A, B, C, D)}{R_{sq}} = \frac{R_{\square} \cdot \pi \cdot r_{max}}{2R_{sq}}$$

Since $R_{sq}$ is the resistance in the elementary square, which as shown before is a surface portion, in which the resistance is the same as in every other such square within this section of the electroconductive layer, it can be assumed that $R_{sq}=R_{sec}$ (resistance of section).

$$\text{Consequently} = \frac{17 \cdot \pi \cdot r_{max}}{2R_{sec}}.$$

Again, if the layout is selected, in which the maximal radius of the circle-shaped figure $r_{max}$ is 14 mm, then at the total surface resistance of the electroconductive layer consisting of one section $R_{total}$=93.15, width w will be equal to:

$$\omega = \frac{17 \cdot 3.14 \cdot 14}{2 \cdot 93.15} = 4.01 \text{ mm}$$

Another layout of electrically insulated zones with a honeycomb structure, which is currently considered to be the most preferred, will be described below.

Surface of glass with electrically heated (resistive) layer may be divided into fragments having the shape of elementary rectangles 4 (FIG. 8) covering the entire area, wherein each of these fragments has:

$$A=B=C=r_{max}$$

where $r_{max}$ is the radius of the circumscribed circle, i.e. $r_{max}$ is the maximum possible radius of the circle circumscribed around the electrically heated area having the shape of regular hexagon.

1) Calculate the size of the elementary initial rectangle (FIG. 8) on X axis:

$$X = r_{max} + \frac{r_{max}}{2} = 1.5r_{max}$$

2) Calculate the size of the elementary initial rectangle on Y axis:

$$Y=2r_{max}\cdot\text{Sin } 60$$

3) Then the resistance of the elementary initial rectangle on axis X is:

$$R_{in.rect} = \frac{R_{\square} \cdot X}{Y} = \frac{R_{\square} \cdot 1.5r_{max}}{2r_{max} \cdot \text{Sin}60} = \frac{R_{\square} \cdot 1.5}{2r_{max} \cdot \text{Sin}60}$$

4) Reduce the radius (size of cell). When the cell radius is reduced, width (w) of strips A, B, C is the same (FIG. 9). Resistance of strips A, B, C is also the same: $R=R_A=R_B=R_C$.

Figure 9:
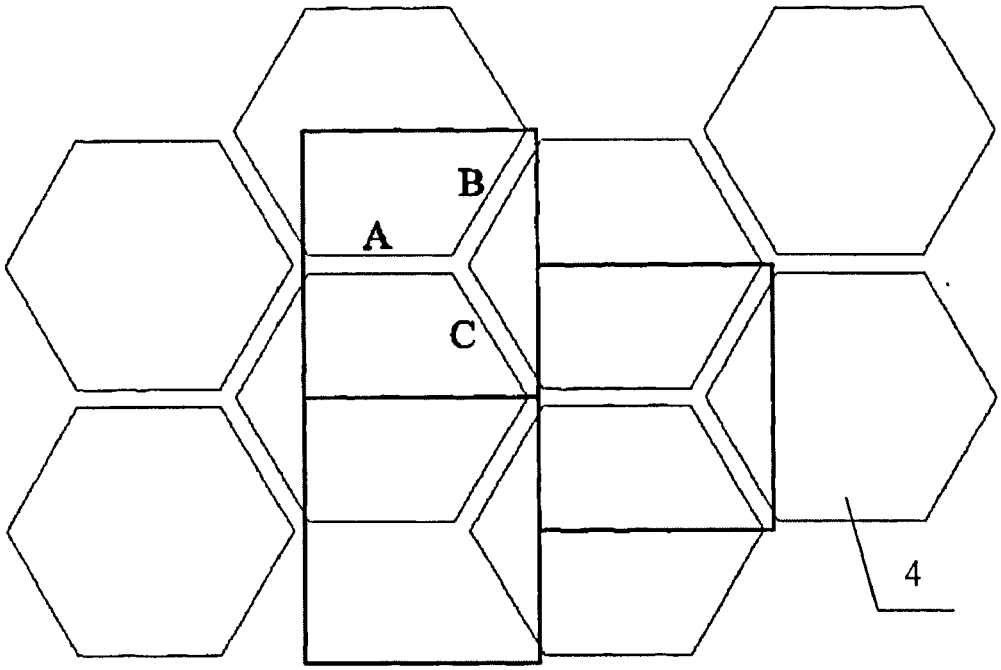
FIG. 9 is a fragment of the basic honeycomb structure according to FIG. 8, in which regular hexagons are separated by electroconductive strips.
Figure 12:
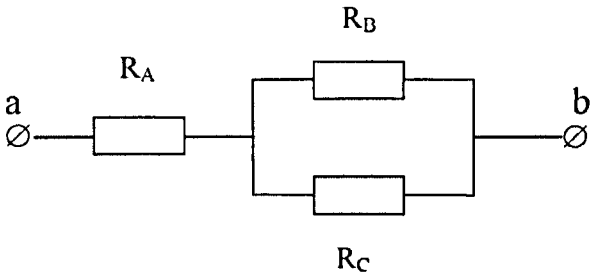

The layout of strips shown in FIG. 9 can be represented as a resistance circuit shown in FIG. 12.

Resistance between a and b is equal to $R_A+R_B\cdot R_C/(R_B+R_C)=1.5R$.

Length (l) of strips A, B, C is assumed equal to the length of the middle line (simplified) and equal to $r_{max}$;

then resistance of one strip is:

$$R_{strip} = \frac{R_{\square} \cdot l}{w}$$

where $R_{\square}$ is the specific resistivity of the resistive layer (16-19 ohms/$_{\square}$ for K-glass).

Width w of the strip is equal to:

$$w=(r_{max}\cdot\text{Sin } 60-r_{sp} \text{ Sin } 60)=2 \text{ Sin } 60(r_{max}-r_{sp}),$$

where $r_{sp}$ is the specified cell radius (reduced by a certain amount relative $r_{max}$).

Resistance of strip (A, B or C) is equal to:

$$R_{strip} = \frac{R_{\square} \cdot r_{max}}{2\mathrm{Sin}60(r_{max} - r_{min})}$$

Total resistance of the rectangle obtained upon division of cells with size $r_{max}$ is:

$$R_{rect} = \frac{1.5 \cdot R_{\square} \cdot r_{max}}{2\mathrm{Sin}60(r_{max} - r_{min})}$$

Then magnification factor K is:

$$K = \frac{R_{rect}}{R_{in\ rect}} = \frac{1.5 \cdot R_{\square} \cdot r_{max} \cdot 2\mathrm{Sin}60}{2\mathrm{Sin}60(r_{max} - r_{min}) \cdot 1.5 \cdot R_{\square}} = \frac{r_{max}}{r_{max} - r_{min}}$$

Inverse formula is:

$$r_{sp} = r_{max} - r_{max}/K.$$

Alternatively, the formula can be written differently in relation to the total surface of any area:

$$r_{sp} = r_{max} - r_{max} \cdot R_{in}/R_{sp}, \text{ where}$$

$R_{sp}$ is the specified resistance of the area, and $R_{in}$ is the initial resistance of the area without electrically insulated zones.

In accordance with the present invention the regular hexagon shape of electrically insulated zones is just one of the most preferred embodiments thereof, which provides a more convenient way to calculate dimensions of the zones, however those skilled in the art will appreciate that any other shapes of electrically insulated zones are possible, which form a honeycomb structure in the electroconductive layer.

In general, according to the invention electrically insulated zones may be formed by any figures bounded by closed lines, which form e.g. a honeycomb structure. The figures have the same size within a section or sections and are positioned at least along the structure rows having the same direction and the same distance between centers of circles, in each of which the corresponding figure can be placed such that the most distant points of the figure belong to the circle.

It is clear that upon modifying the size of electrically insulated zones the current path length and surface resistance of the electroconductive layer change, so the size of electrically insulated zones should be chosen depending on the shape and size of the glass product. Furthermore, according to the invention electrically insulated zones have own resistance magnification factor K in each section of electrically heated surface of glass.

Figure 13:
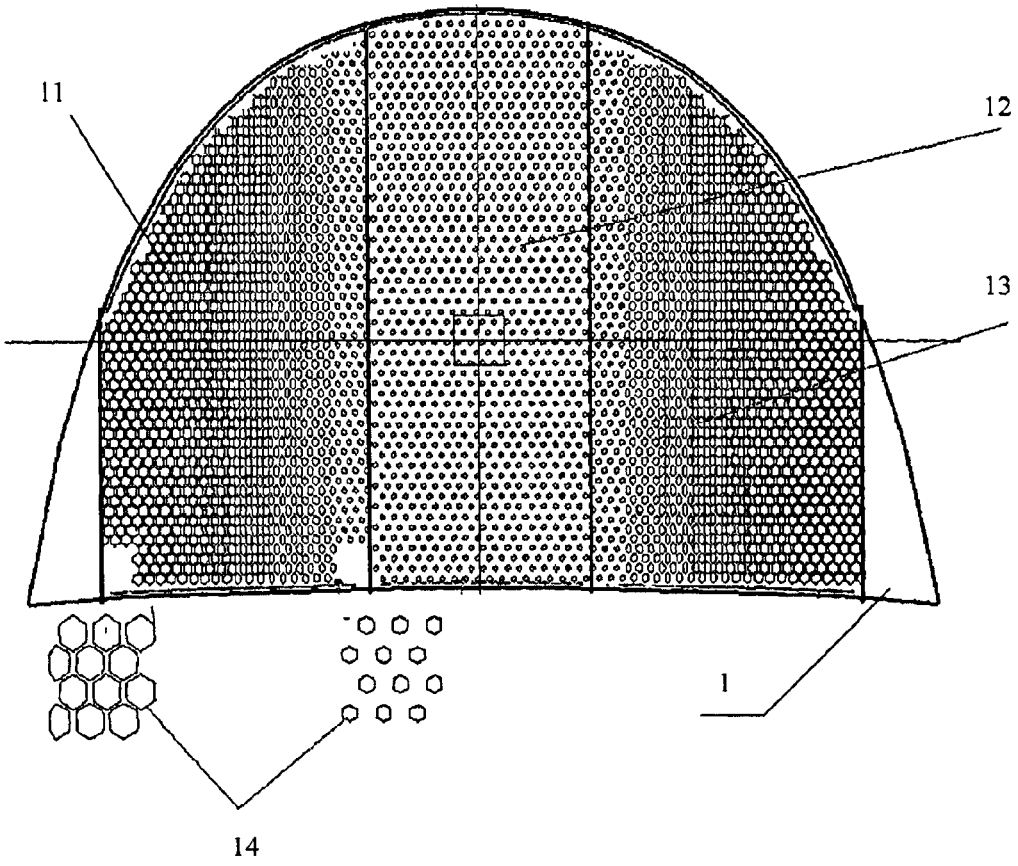
FIG. 13 is a schematic view of a glass product with an electroconductive layer comprising a plurality of sections with electrically insulated zones.

As shown by way of example in FIG. 13, electrically heated glass product 1 has three sections 11, 12 and 13, where sections 11 and 13 have a honeycomb structure, which differs from the honeycomb structure 12 only by the size of regular hexagons 14, while the pitch or distance between electrically insulated zones having the shape of regular hexagons 14 remains constant over the entire surface of the glass product 1.

Electrically insulated areas, in which low emissivity coating is to be removed, are preferably calculated by dedicated software in which data is entered in accordance with the kind and layout of the figures. This enables the manufacture of glass products for various purposes: structural optics, automobile, aviation and armor glass, or electrically heated architectural structures.

Those skilled in the art will appreciate that the invention is not limited to the embodiments presented above, and that modifications may be included within the scope of the claims presented below. Distinguishing features presented in the description together with other distinguishing features, as appropriate, may also be used separately from each other.

The invention claimed is:

1. A method of manufacturing a glass product with electrically heated surface, comprising the steps of:

producing a substantially transparent substrate;

applying a substantially transparent electroconductive layer to the substrate; and forming in the electroconductive layer at least one section with electrically insulated zones separated by electroconductive strips, which at least partially deviate from the longitudinal direction of the section and consist of straight and/or curved portions having substantially the same width w within one section, the width being selected for a specified configuration of electrically insulated zones as a function of desired total resistance $R_{total}$ of the section, consisting of the combination of resistances $R_N$ of said strip portions, wherein resistance $R_N$ of each strip portion is determined from the equation:

$$R_N = \frac{R_{\square} \cdot l_N}{w}$$

where $R_{\square}$ is the specific resistivity of the electroconductive layer;

w is the width of the strip, and $l_N$ is the length of each portion of the strip.

2. A method according to claim 1, wherein curvature of the curved portions is varied in accordance with a specified function.

3. A glass product with electrically heated surface, comprising:

a substantially transparent substrate, and a substantially transparent electroconductive layer applied to the substrate and containing at least one section with electrically insulated zones having the shape of regular hexagons forming a honeycomb structure and separated by electroconductive strips having substantially the same width within one section, said regular hexagons having the same dimensions within one section and positioned with the same distance between centers of circles circumscribed around them all over the electroconductive layer, wherein specified radius $r_{sp}$ of the circles within one section is calculated by the formula:

$$r_{sp} = r_{max} - r_{max} \cdot R_{in}/R_n, \text{ where}$$

$r_{max}$ is the maximum radius of the circle for the basic honeycomb structure with adjoining regular hexagons;

$R_n$ is the specified surface resistance of the section, and $R_{in}$ is the surface resistance of the initial section without electrically insulated zones.

4. A glass product according to claim 3, wherein bus bars are formed along edges of the glass product at a distance from each other.

5. A glass product according to claim 3, wherein said electrically insulated zones comprise an electroconductive layer inside them.

* * * * *